US005429185A

United States Patent [19]

Trage et al.

[11] Patent Number: 5,429,185

[45] Date of Patent: Jul. 4, 1995

[54] HEAT EXCHANGER WITH A PLURALITY OF PARALLEL HEAT EXCHANGER TUBES

[75] Inventors: Burkhard Trage; Harald Sassmann, both of Ratingen; Wolfgang Holten, Düsseldorf; Miroslav Podhorsky, Ratingen, all of Germany

[73] Assignee: Balcke-Durr Aktiengesellschaft, Ratingen

[21] Appl. No.: 271,279

[22] Filed: Jul. 6, 1994

[30] Foreign Application Priority Data

Jul. 6, 1993 [DE] Germany ..... 43 22 405.9
Jul. 20, 1993 [DE] Germany ..... 9310827 U

[51] Int. Cl.[6] ..... F28F 1/14
[52] U.S. Cl. ..... 165/152; 165/183
[58] Field of Search ..... 165/152, 153, 183

[56] References Cited

U.S. PATENT DOCUMENTS 2,035,665 3/1936 Palmer ..... 165/152

FOREIGN PATENT DOCUMENTS 79663 12/1919 Austria ..... 165/152
542365 8/1959 Belgium ..... 165/152
4957 9/1953 Germany .
2352950 4/1975 Germany .
2813747 10/1979 Germany .
3315314 10/1984 Germany .
3620345 12/1987 Germany .
4039293 7/1992 Germany .
4042195 7/1992 Germany .
4219619 1/1994 Germany .
547118 8/1956 Italy ..... 165/152

*Primary Examiner*—Allen J. Flanigan
*Attorney, Agent, or Firm*—Robert W. Becker & Associates

[57] ABSTRACT

A heat exchanger has a plurality of parallel heat exchanger tubes with two plane sides and two narrow sides. The heat exchanger tube has a contour with a width and a height in a direction of flow of a first heat-exchanging medium such that the width is much greater than the height. Ribs are connected to the plane sides of the heat exchanger tubes. The ribs are made of a rib band folded to a meander-shape with bent portions. Adjacent ones of the ribs form a flow cross-section for a second heat-exchanging medium. The ribs have a plurality of openings wherein the size of the opening is at least equal in size to the size of the flow cross-section between adjacent ribs.

9 Claims, 4 Drawing Sheets

HEAT EXCHANGER WITH A PLURALITY OF PARALLEL HEAT EXCHANGER TUBES

BACKGROUND OF THE INVENTION

The present invention relates to a heat exchanger comprised of a plurality of parallel heat exchanger tubes having a flow cross-section for the flow of a medium partaking in the heat exchange which flow cross-section has a great width compared to its height, whereby at each of the two plane sides of the heat exchanger tubes ribs are attached that are formed from a rib band which is meander-shaped.

A heat exchanger of this kind is known from German Offenlegungsschrift 40 39 293. The heat exchanger tubes used in this embodiment are comprised of two half shells to which are fastened ribs with a suitable device. Subsequently, the two half shells are connected to one another so that heat exchanger tubes with a cross-section of an elongate oval result. The ribs in this known heat exchanger are formed from a rib band which, before fastening to the plane surfaces of the individual heat exchanger tube, is bent multiple times to provide a meander-shape for the required rib design. Subsequently, the thus formed and shaped rib band is connected to the respective plane sides of the heat exchangers tubes.

In one of the embodiments of the known heat exchanger it is suggested to provide the ribs, manufactured from an endless rib band and forming a continuous channel over the length of the plane sides, with stamped areas in the form of lateral projections. In this manner, the medium flowing within the channels formed by the ribs is subjected to an increased turbulence which is favorable for increasing the heat exchange effect.

However, it is disadvantageous with the known heat exchanger of the aforementioned kind that the channels formed by the ribs have a relatively high soiling tendency. Due to the stamped areas in the form of individual lateral projections, this soiling tendency increases even more so that especially at these locations soil particles are easily deposited which, with continuous use of the heat exchanger, can result in the complete closure of the respective channel. This results in an undesirable local decrease of the heat exchange capacity of the heat exchanger.

It is therefore an object of the present invention to improve the known heat exchanger such that the effect of possibly present contamination on the heat exchange capacity of the heat exchanger is reduced.

SUMMARY OF THE INVENTION

The heat exchanger of the present invention is primarily characterized by:

A plurality of parallel heat exchanger tubes with two plane sides and two narrow sides;

The heat exchanger tubes having a contour with a width and a height in a direction of flow of a first heat exchanging medium, wherein the width is much greater than the height;

Ribs connected to the plane surfaces of the heat exchanger tubes, the ribs comprised of a rib band folded to a meander-shape with bent portions, wherein adjacent ones of the ribs form a channel of a flow cross-section therebetween for a second heat-exchanging medium; and The ribs having a plurality of openings wherein a size of the opening is at least equal in size to a size of the flow cross-section of the channel between adjacent ones of the ribs.

Preferably, the openings are positioned in the vicinity of the bent portions facing away from the plane surface of the heat exchanger tubes such that an exchange of the second heat-exchanging medium between the channels of neighboring ones of the heat exchanger tubes is possible.

Advantageously, the openings of the ribs are congruently positioned with the openings of the ribs of the neighboring heat exchanger tubes.

In a preferred embodiment of the present invention the ribs have lateral surfaces with a foot area adjacent to the plane sides. The lateral surfaces have orifices in the foot area and the orifices have a size smaller than the size of the flow cross-section between the ribs.

Preferably, the orifices are located at half a distance between two adjacent ones of the openings.

Preferably, the lateral surfaces have stamped projections and recesses.

Advantageously, the meander-shape, in a side view of the rib band, is comprised of U-shaped units such that the bent portions at a bottom of the U-shaped unit form therebetween a flat surface for abutting at the plane sides of the heat exchanger tubes and at the flat surfaces of adjacent ones of the rib bands of a neighboring one of the heat exchanger tubes.

In a preferred embodiment of the present invention, the bent portions are connected to the plane sides of the heat exchanger tubes with a continuous, linear, welded connection, wherein the welded connection is preferably produced by capacitor discharge welding.

According to the present invention, the ribs are provided with a plurality of openings having a size that is at least equal to the size of the flow cross-section of the channels between adjacent ribs.

With this measure it is achieved that in the case of local contamination, and especially in the case of closure of individual channels or their flow cross-sections, a rerouting of the stream of heat-exchanging medium into neighboring channels or flow cross-sections is possible via the openings so that the flow constriction and thus the loss of heat exchange capacity is only minimal. When flowing through a channel (flow cross-section) formed by neighboring ribs is no longer possible, the stream of the heat-exchanging medium can flow via one of the openings arranged within the ribs into the neighboring channel (flow cross-section) and can continue to flow within the channel. After overcoming the obstacle the stream can then return via another opening into the original channel (flow cross-section). The thus achieved combination of two streams into a single channel has no noticeable disadvantages with respect to the heat exchange capacity because in the area of deflection of the stream the flow velocity is forcibly increased so that the heat exchange capacity is locally increased. Accordingly, the loss of heat exchange capacity within the clogged cross-section is partially compensated.

According to a preferred embodiment the openings are provided within the vicinity of the bent portions of the ribs arranged remote from the plane sides of the heat exchanger tubes so that an exchange of the heat-exchanging medium with the medium within the channels of an adjacent heat exchanger tube is possible. This also ensures that heat exchange capacity losses due to soiling are more uniformly distributed over the individual heat exchanger tubes of the heat exchanger. This effect is further increased when the openings are congruently placed relative to the openings of the ribs of the neighboring heat exchanger tube.

The flow exchange between the channels formed by the ribs is further improved when the lateral surfaces of the ribs in the foot area of the ribs are provided with additional orifices having a cross-section the size of which is smaller than the size of the flow cross-section of the channels between two neighboring ribs.

In order to be able to achieve a high mechanical stability of the rib band despite the openings and orifices, the additional orifices are preferably positioned at half a distance between two adjacently arranged openings.

An especially good connection between the rib band and the respective heat exchanger tube is achieved when according to a preferred embodiment the basic meander shape of the rib band is rectangular, i.e., is comprised of U-shaped units, so that the bent portions produce flat surfaces for abutment at the plane sides of the heat exchanger tubes and the correspondingly designed flat surfaces of the rib band of a neighboring heat exchanger tube. This also improves the mutual support action between neighboring heat exchanger tubes.

In a further embodiment of the inventive heat exchanger it is suggested to provide stamped projections and recesses within the lateral surfaces of the ribs. These stamped recesses and projections generate or reinforce a turbulence of the medium flowing through the channels defined by the ribs such that the heat exchange capacity is additionally increased.

According to another embodiment of the invention the bent portions are connected with a linear, continuous welded connection to the plane sides of the heat exchanger tubes. In this manner, an especially good metallic connection between the parts and thus an increased heat transfer between the heat exchanger tube and ribs results.

Preferably, the welding of the bent portions to the respective plane sides is carried out with a capacitor discharge welding method. This welding method allows for the plane (wide) sides of the base body of the tube to adapt without gaps to the contour of the respective rib foot area upon combining the rib sheet metal and the heat exchanger tube. The required pressing force is generated by two electrodes which are components of the capacitor discharge welding device. While one of the electrodes is inserted at the rib foot area between two adjacently arranged ribs, the other electrode abuts at the corresponding inner side of the base body of the tube and thus forms an abutment. In this manner a gap-free contact of the parts to be connected is provided so that after completed discharge of the capacitors the capacitor discharge welding device provides a linear connection of the ribs to the base body of the tube. Thus, a very good heat transfer between these parts is achieved.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 5.

Figure 1:
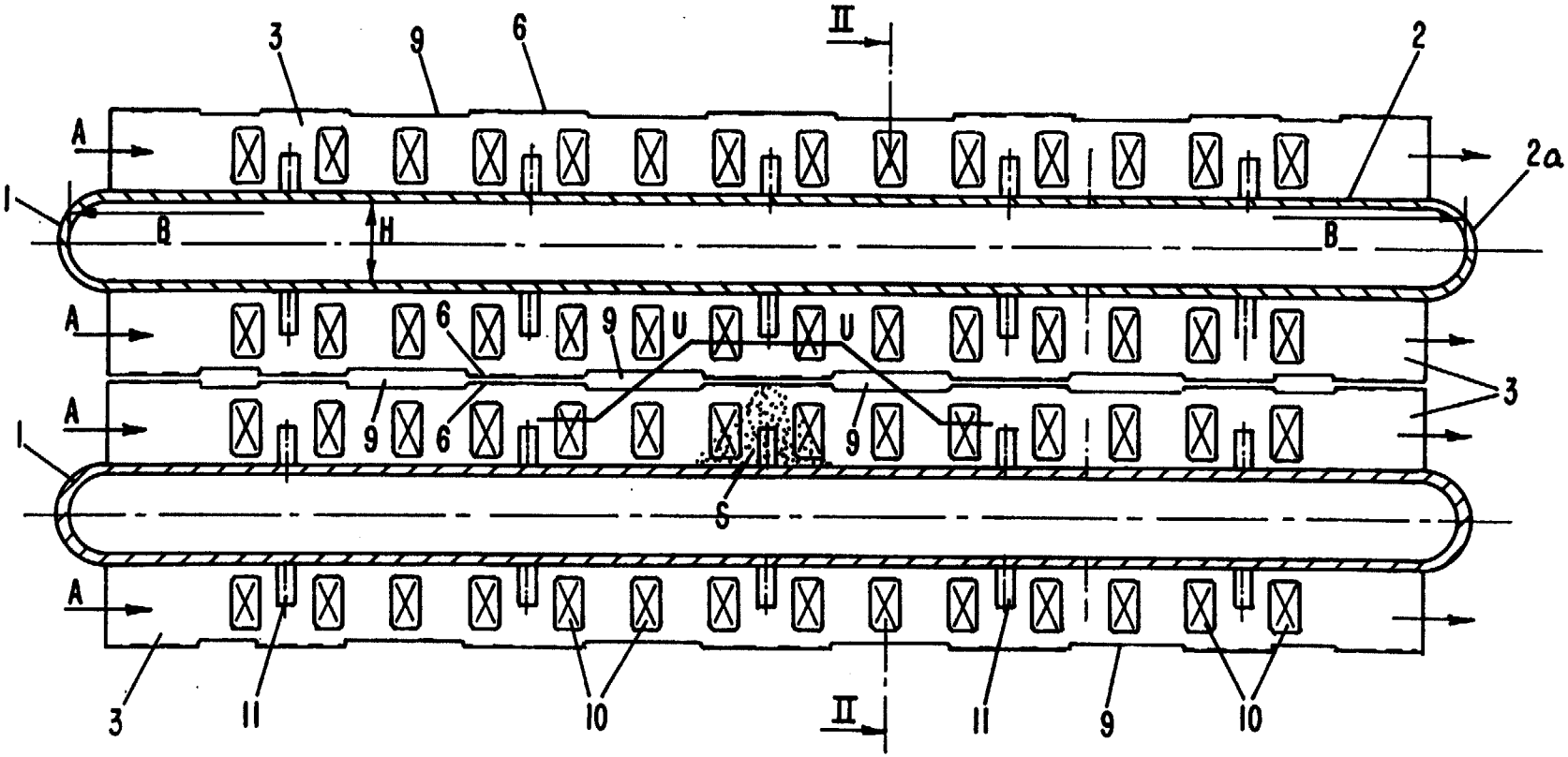
FIG. 1 shows in section a heat exchanger with two parallel heat exchanger tubes which are provided on both plane sides with ribs.

The heat exchanger represented in FIG. 1 is comprised of heat exchanger tubes 1 which are arranged parallel to one another in the manner of a package. For reasons of simplifying the drawing only two such heat exchanger tubes are shown in FIG. 1.

FIG. 1 illustrates that the cross-section of the heat exchanger tube 1 for the flow of a first heat-exchanging medium has a width B which is substantially greater than the height H. The longitudinal edges of the thus formed heat exchanger tube are rounded so that overall the cross-section is an elongate oval.

The second heat exchanging medium is guided in cross-flow over the outer plane sides 2 of the heat exchanger tube 1. In order to increase the heat exchange effect, ribs 3 are arranged on the respective plane sides 2 of the heat exchanger tube 1 in question to thereby increase the effective heat exchanging surface area. The ribs 3 are formed from an endless or continuous sheet metal by repeatedly bending so that in the longitudinal direction of the heat exchanger tube 1 the ribs 3 have a meander shape. This is illustrated especially well in FIG. 2.

Figure 2:
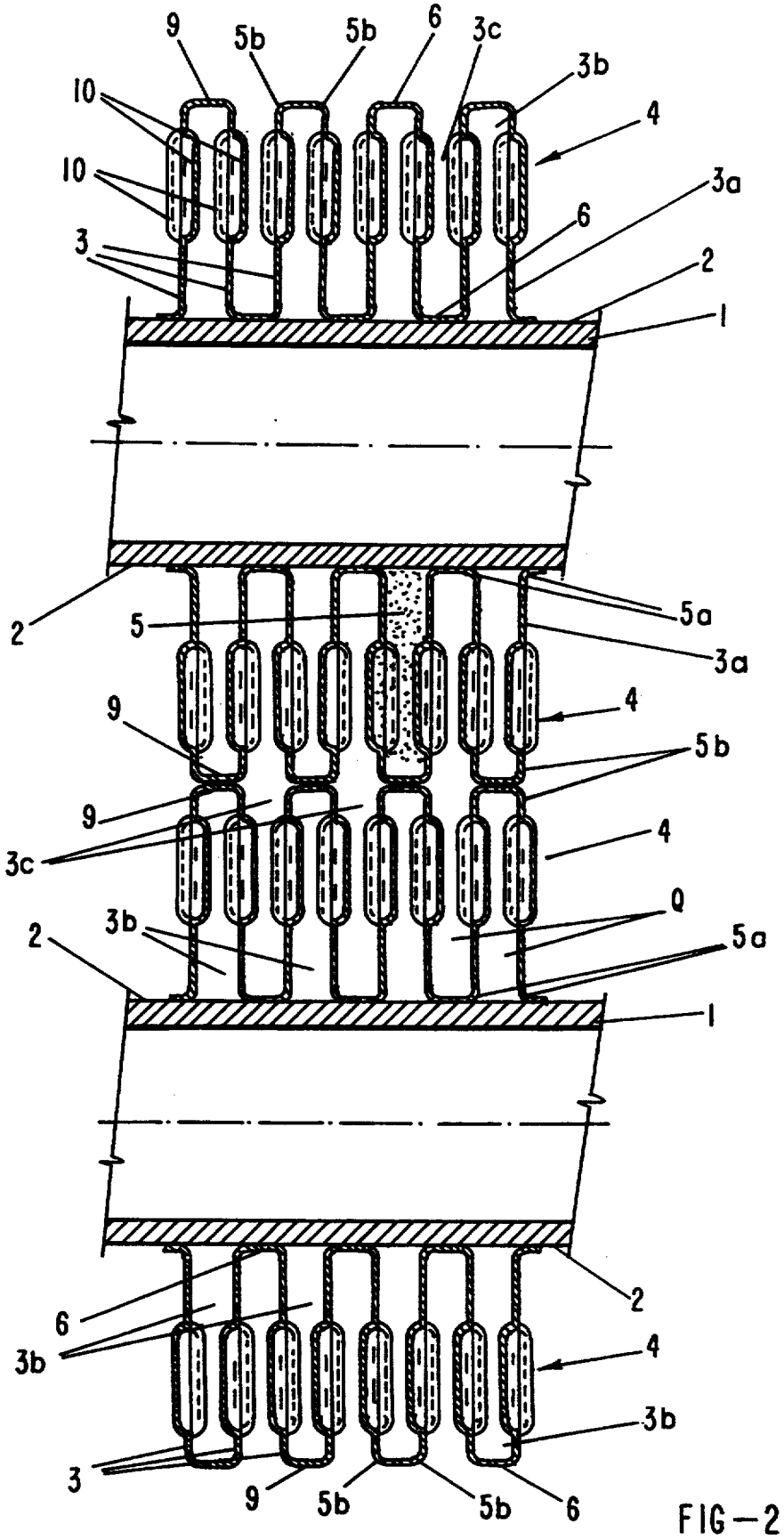
FIG. 2 shows a section along the line II—II of FIG. 1.

The basic meander shape of the thus formed rib bands 4, as can be seen in FIG. 2, are rectangular, i.e., are comprised of U-shaped units so that the bent portions 5 facing the heat exchanger tube 1, respectively, facing away from the heat exchanger tube 1 form therebetween flat surfaces 6. The flat surfaces 6 serve as a good connection of the rib foot area to the plane sides 2 of the heat exchanger tube 1. As a material for the rib band 4 sheet steel of a thickness of 0.1 to 0.4 mm is especially suitable whereby the sheet steel can be plated on both sides with a thin aluminum layer.

The ribs 3 which are comprised of meander-shaped bent rib bands 4 are positioned on both plane sides 2 of the heat exchanger tubes 1. The thus designed heat exchanger tubes 1 can be assembled to any desired package size whereby the fastening as well as the spacing of the individual heat exchanger tubes 1 relative to one another is carried out at their ends. It is desirable that the bent portions 5 at the ends of the ribs 3 have a distance as small as possible to the oppositely arranged bent portions 5 of the neighboring heat exchanger tube 1. The distance, however, should not be so small that contacting between the ribs 3 of neighboring heat exchanger tubes 1 could occur.

For connecting the rib foot area to the plane sides 2 of the heat exchanger tube, a capacitor discharge welding process is used which will be explained in the following with the aid of FIGS. 3, 4 and 5.

The capacitor discharge welding process is a special kind of resistance welding in which the required energy during welding is not directly drawn from an electrical supply net via a transformer, but provided via capacitor batteries that serve as an energy storage system when the device is not being used for welding. The advantage of a capacitor discharge welding process is its suitability for the use of different material combinations, for example, steel/aluminum. Furthermore, with this method it is possible to weld also surface-treated materials, for example, galvanized or aluminized sheet metal without damaging the surface.

The capacitor discharge welding process uses two separate electrodes 7, 8. In the embodiment shown, the upper electrode 7 is comprised of five disk-shaped individual electrodes 7' made of a suitable electrode material, for example, CuCrZr. The lower electrode 8 is in the form of a plate which extends over the entire width of the heat exchanger tube 1 and is provided with a contour corresponding exactly to the inner profile of the heat exchanger 2. In this manner, the lower electrode also serves as a guide for the base body of the heat exchanger tube 1 during the welding process. Of special importance, however, is the use of the lower electrode 8 as an abutment for the pressure forces generated by the upper electrode 7. For this purpose, the lower electrode 8 is supported in a suitable manner with interposition of an insulation material at the welding device to be used. The alignment of the upper electrode 7 is such that the individual electrodes 7' can be inserted with their narrow end faces exactly between two neighboring ribs 3 until abutting at the inner surface of the flat surface 6 arranged between the rib foot areas 3*a*. Spring elements 7*a* provide a defined pressure force which is received by the electrode 8 acting as an abutment. As soon as the predetermined pressure level has been reached, the capacitors of the welding device are discharged so that for a short period of time a high energy stream flows from the upper electrode 7 to the lower electrode 8. Due to the concentration of the welding energy within the welding zone as well as due to the very short welding time of 1 to 10 milliseconds, no substantial heating of the components occurs. The finished heat exchanger components are removed from the welding device practically cold. Thus, they remain true to form and have no tendency to distortional warping.

By using a plurality of independent upper electrodes 7', slight bending can be compensated and a linear continuous welding connection of the ribs 3 to the respective plane sides 2 of the heat exchanger tube 1 is achieved.

Figure 4:
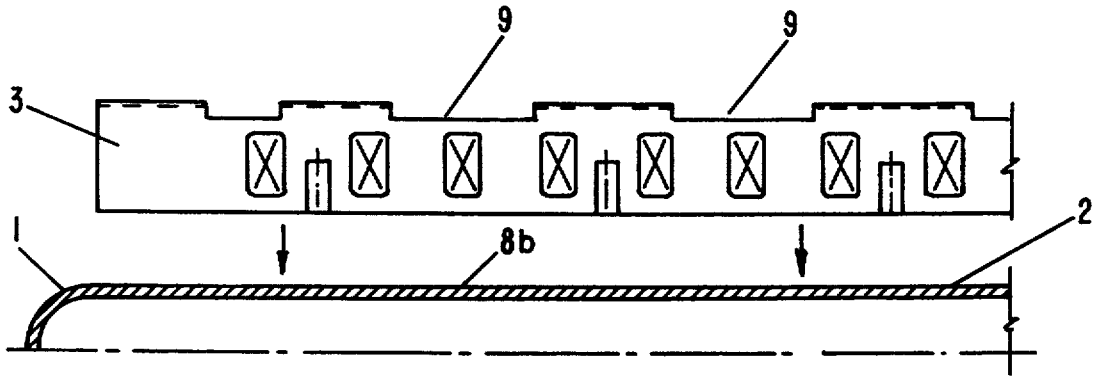
FIG. 4 shows in section the parts to be combined according to FIG. 3 directly before assembly and welding.
Figure 5:
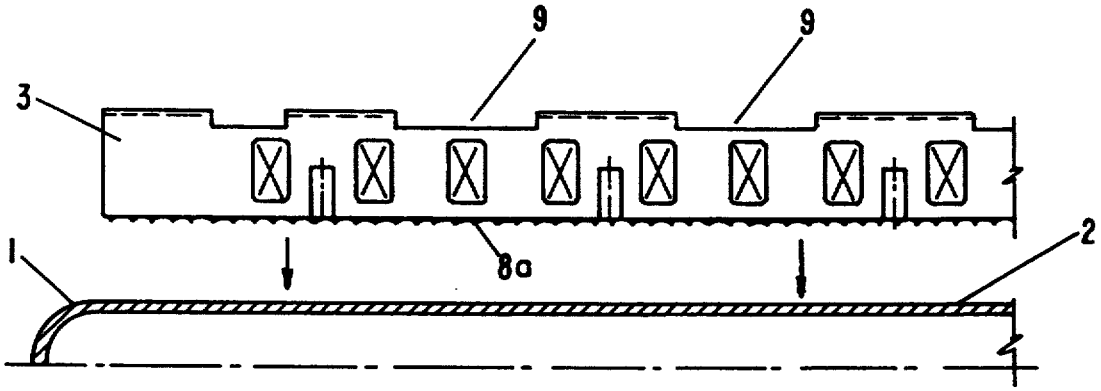
FIG. 5 shows in section the parts to be connected according to FIG. 3 directly before assembly, respectively, welding in a method that differs slightly from the method of FIG. 4.

FIGS. 4 and 5 show heat exchanger tube 1 and ribs 3 directly before their assembly whereby the surfaces to come into contact with one another are provided with texturing that is repeated over its length. In the embodiment according to FIG. 4 the exterior plane sides 2 of the heat exchanger 1 are provided with fine uniform ripples 8*b* with a depth of approximately 0.1 to 0.3 mm. In the embodiment according to FIG. 5 the repeating texturing is provided at the underside of the rib foot area 3*a*, i.e., in the area of the bent portions 5. The bent portions 5 are provided with stamped portions in the shape of downwardly extending projections 8*a*.

The effect of these projections 8*a*, 8*b* is the same for both embodiments of FIGS. 4 and 5: After abutting the parts to be connected, a direct metallic contact between the participating surfaces takes place only within the area of the projections 8*a*, 8*b*. This abutting contact establishes metallic bridges of precisely defined position and size via which the welding energy released from the electrodes 7, 8 can be initially discharged. Due to the suddenly occurring melting process, these projections are removed so that after complete discharge an especially uniform welding connection results. This welded connection is especially more favorable than a connection based on randomly roughened surface areas.

Figure 3:
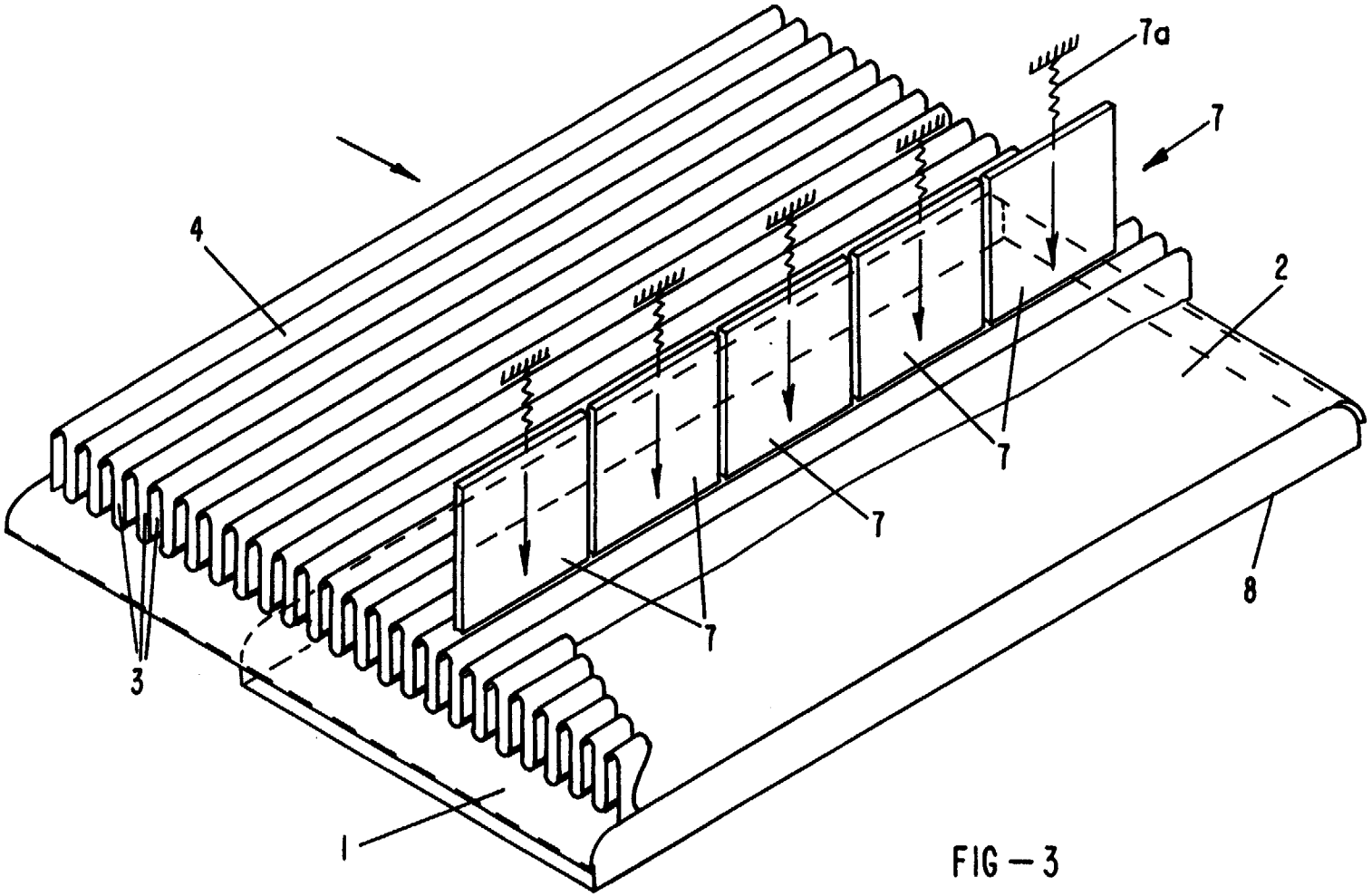
FIG. 3 shows a perspective view of the sequence of the method steps for manufacturing the heat exchangers of FIGS. 1 and 2 by using a capacitor discharge welding method.

In FIG. 3, the rib band 4 is represented as a continuous meander-shaped folded sheet metal without further structures. However, this representation is a simplified representation. In the context of the present invention, the ribs do not form closed channels over their entire length but are provided in uniform spacing with openings 9 as can be seen in the exact representations FIG. 1, FIG. 2, FIG. 4 and FIG. 5. These openings 9 are arranged in the vicinity of the bent portions 5 facing away from the plane sides 2 of the heat exchanger tube 1, i.e., are positioned in the area of the free ends of the ribs 3. Via these openings 9 an exchange of the second heat exchanging medium respectively contained within the channels 3*b* of the ribs of neighboring heat exchanger tubes can take place.

The function of the openings 9 will be explained in the following with the aid of FIG. 1. The flow direction is indicated by arrows A and indicates the inlet for the flow of the second heat exchanger medium into the channels 3*b* formed by the ribs. In one of the flow cross-sections of the ribs a contamination S is present. Since flow of the second heat exchanger medium in this area is impossible, a flow through this cross-section would be completely prevented in a heat exchanger of the conventional kind. Due to the inventively provided openings 9, however, the flow of heat exchanger medium can follow the path of detour U (FIG. 1). Accordingly, the stream of heat exchanger medium is guided through the opening 9 upstream of the obstacle into a flow cross-section of a channel 3*b* which is formed by the ribs of the adjacent heat exchanger tube 1. This results in an increase of the flow velocity therein. After circumventing the obstacle, a portion of the stream of heat exchanger medium can return into the original flow cross-section via the opening 9 arranged downstream so that the flow of the second heat exchanger through the heat exchanger is essentially uniform when exiting the heat exchanger.

The above described function is ensured when the opening cross-section of each opening 9 has at least the same size as the flow cross-section Q of the channel 3*b* between two neighboring ribs 3.

The individual ribs 3 are provided with additional geometric structures which serve to intermix or to generate turbulence within the heat exchanging medium flowing through the channels, respectively, flowing past the structures. For this purpose, the lateral surfaces of the ribs 3 are provided with stamped projections and recesses 10 extending alternatingly to one side or the other of the ribs 3. These projections and recesses 10 result in a considerable increase of turbulence of the medium flowing through the channels of the ribs 3o In order to achieve an exchange between the corresponding inner channels 3*b* of the ribs and the neighboring exterior channel 3*c* of the ribs additional orifices 11 are provided. They are located at the lateral surfaces of the ribs 3 within the area of the foot section 3*a*. Their opening cross-section is considerably smaller than the opening cross-section of the openings 9, especially smaller than the size of the flow cross-section Q of a channel 3*b* between two neighboring ribs 3. FIG. 1 shows that the additional orifices 11 are positioned at half the distance between the sequentially arranged openings 9.

The present invention is, of course, in no way restricted to the specific disclosure of the specification and drawings, but also encompasses any modifications within the scope of the appended claims.

What we claim is:

1. A heat exchanger comprising:

a plurality of parallel heat exchanger tubes with two plane sides and two narrow sides;

said heat exchanger tubes having a contour with a width and a height in a direction of flow of a first heat-exchanging medium, wherein said width is much greater than said height;

ribs connected to said plane sides of said heat exchanger tubes, said ribs comprised of a rib band folded to a meander-shape with bent portions, wherein adjacent ones of said ribs form a channel of a flow cross-section therebetween for a second heat-exchanging medium; and said ribs having a plurality of openings, wherein the size of said opening is at least equal in size to the size of said flow cross-section of said channel between adjacent ones of said ribs.

2. A heat exchanger according to claim 1, wherein said openings are positioned in the vicinity of said bent portions facing away from said plane sides of said heat exchanger tubes such that an exchange of the second heat-exchanging medium between said channels of neighboring ones of said heat exchanger tubes is possible.

3. A heat exchanger according to claim 2, wherein said openings of said ribs are congruently positioned with said openings of said ribs of said neighboring heat exchanger tubes.

4. A heat exchanger according to claim 1, wherein:

said ribs have lateral surfaces with a foot area adjacent to said planar surfaces;

said lateral surfaces have orifices in said foot area; and said orifices have a size smaller than said size of said flow cross-section between said ribs.

5. A heat exchanger according to claim 4, wherein said orifices are located at half a distance between two adjacent ones of said openings.

6. A heat exchanger according to claim 4, wherein said lateral surfaces have stamped projections and recesses.

7. A heat exchanger according to claim 1, wherein said meander shape, in a side view of said rib band, is comprised of U-shaped units such that said bent portions at a bottom of said U-shaped unit form therebetween a flat surface for abutting at said plane sides of said heat exchanger tubes and at said flat surfaces of adjacent ones of said rib bands of a neighboring one of said heat exchanger tubes.

8. A heat exchanger according to claim 1, wherein said bent portions are connected to said plane sides of said heat exchanger tubes with a continuous, linear welded connection.

9. A heat exchanger according to claim 8, wherein said welded connection is produced by capacitor discharge welding.

* * * * *